US006354257B1

(12) United States Patent
Marshall et al.

(10) Patent No.: US 6,354,257 B1
(45) Date of Patent: Mar. 12, 2002

(54) SYSTEM AND METHOD FOR PREVENTING START PINION/GEAR RING ENGAGEMENT DURING SELECTED ENGINE START CONDITIONS

(75) Inventors: Brian P. Marshall, Fort Wayne, IN (US); Brent A. Barnhart, Van Wert, OH (US)

(73) Assignee: International Truck and Engine Corp., Warrenville, IL (US)

( * ) Notice: Subject to any disclaimer, the term of this patent is extended or adjusted under 35 U.S.C. 154(b) by 0 days.

(21) Appl. No.: 09/635,813

(22) Filed: Aug. 9, 2000

(51) Int. Cl.[7] ..... F02N 11/08
(52) U.S. Cl. ..... 123/179.3; 290/38 R
(58) Field of Search ..... 123/179.3, 179.4, 123/179.25; 290/38 R, 37 A

(56) References Cited

U.S. PATENT DOCUMENTS 4,416,235 A 11/1983 Utsumi et al.
4,916,327 A 4/1990 Cummins
5,337,713 A * 8/1994 Mills ..... 123/179.3
6,062,186 A 5/2000 Barnes et al.

* cited by examiner

*Primary Examiner*—Andrew M. Dolinar
(74) *Attorney, Agent, or Firm*—Dennis Kelly Sullivan; Jeffrey P. Calfa; Gilberto Hernandez

(57) ABSTRACT

The invention provides a cranking inhibition control system for an electric starter to an internal combustion engine. Engine rotational speed is developed from the signal produced by a cam shaft position sensor, which drives the logic of the system. Responsive to changes in engine rotation speed which result in engine speed falling below idle speed, the control logic generates a temporary cranking inhibit signal. Once engine speed falls low enough to clearly indicate cranking has ceased, a timer is triggered which resets the inhibit signal to permit cranking after a suitable delay.

13 Claims, 2 Drawing Sheets

SYSTEM AND METHOD FOR PREVENTING START PINION/GEAR RING ENGAGEMENT DURING SELECTED ENGINE START CONDITIONS

BACKGROUND OF THE INVENTION

1. Technical Field

The present invention relates to internal combustion engine control systems and in particular starting systems for diesel engines.

2. Background to the Invention

An internal combustion engine is routinely cranked for starting. Cranking of the engine continues until the cylinders of the engine begin firing and the engine begins generating sufficient power fully to compress the fuel/air mixture being injected into the cylinders for ignition. In the case of diesel engines, a starter system includes an electric motor of sufficient output to turn an engine crankshaft and to force pistons far enough into cylinders to compress the air/fuel mixture and thereby raise the mixture to its ignition temperature. The electric starter motor typically draws power from a vehicle battery, although other sources may be used. The electrical starter motor drives a pinion gear, which in turn engages a fly wheel ring gear coupled to the engine's crankshaft to crank a motor. A solenoid controls engagement of the pinion with the ring gear by moving the pinion into and out of contact with the ring gear. To prevent damage to the starter motor, excessive wear on the pinion and an unneeded load on the engine during normal operation, the solenoid operates to control positioning of the pinion relative to the ring gear.

Diesel engines rely on compression of the fuel/air mixture to raise the air/fuel mixture temperature to its flash point and can be difficult to start. Due to this factor, among other causes, truck drivers often make several attempts to start a diesel engine. An attempt to start an engine may end with a piston fully or partially inserted into a cylinder and a compressed air/fuel mixture in the cylinder which acts a spring forcing the piston out of the cylinder. In this situation the piston can turn the engine crankshaft in a direction counter to the cranking direction, a phenomena called rock back. If an attempt is made to reengage the pinion with the ring gear, a substantial possibility exists that the pinion will be damaged or stripped.

Accordingly it is preferable that rotation of an engine completely stop before a follow-up attempt to start the engine is made. One technique to achieve this, known to the art, is to force a vehicle operator to fully reset the ignition key to the off position between start attempts. The time taken to do this act is usually sufficient to allow the engine to complete any rock back. Many trucks however have a starter button, rather than, or in addition to, a start position for the ignition key. Such buttons, or ignition keys could be monitored by addition of a monitoring switch which would have to be reset. All such systems involve the additional expense of buying and incorporating such a switch into an engine starting system.

Engine crank inhibit circuitry has been used with trucks built by the Assignee of this Patent to block attempts to crank an engine which is already running. An electronic engine control module (EECM) provides an inhibit signal which prevents cranking by deenergizing a start relay. The EECM has no hardwire connection to either the ignition switch or to a start button and develops the inhibit signal without reference to the position of the ignition switch.

U.S. Pat. No. 4,916,327 to Cummins proposes a pinion block and rock-back protection circuit. Briefly, the '327 circuit provides a capacitive discharge circuit, described from column 18, line 66 to column 19, line 35, which prevents reengaging the starter motor before its complete discharge. This prevents the ignition switch from engaging the starter motor after an excessively quick cycle, which is typically set at 2 seconds, but which can be adjusted. Dedicated circuit elements are used to implement this system.

SUMMARY OF THE INVENTION

The invention provides a control system for an electric starter to an internal combustion engine. Typically, the engine is mounted on a vehicle and is connected by a transmission to a drive shaft. The control system includes a starter switch which electrically connects a cranking motor to a source of electrical power. The engine has a crank shaft ring gear which is open to be engaged. A pinion rotationally driven by the cranking motor is pushed into engagement with the crank shaft ring gear while the cranking motor is turning. An indication of engine rotational speed is developed from the signal produced by a cam shaft position sensor, which functions as a tachometer. Control logic is provided which is responsive the engine rotational speed signal for developing indications of engine deceleration indicative of cessation of cranking and for generating an engine crank inhibit signal having a state reflecting cessation of cranking.

The control logic further comprises a delay line connected to the cam position sensor to receive the engine rotational speed signal and responsive thereto for producing a delayed engine rotational signal. A summing element connected to receive the engine rotational speed signal and the delayed engine rotational speed signal produces a difference signal corresponding to engine acceleration or deceleration. A comparator takes the difference signal and the difference threshold reference signal as inputs and responsive thereto generates a minimum speed change indication signal of one of two states, where a first state indicates a change in engine rotational velocity consistent with cessation of engine cranking and the second state indicating otherwise.

The control logic still further includes a source of an engine speed reference signal, a comparator taking the engine speed reference signal and the engine speed signal as inputs to produce a minimum engine speed signal of one of two states, where a first state indicates that engine speed falls below a minimum threshold and a second state which indicates that engine speed exceeds a minimum threshold. A logical AND gate taking the minimum speed signal and the minimum speed change indication signal as inputs to provide an cranking inhibit set signal when both inputs go high.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
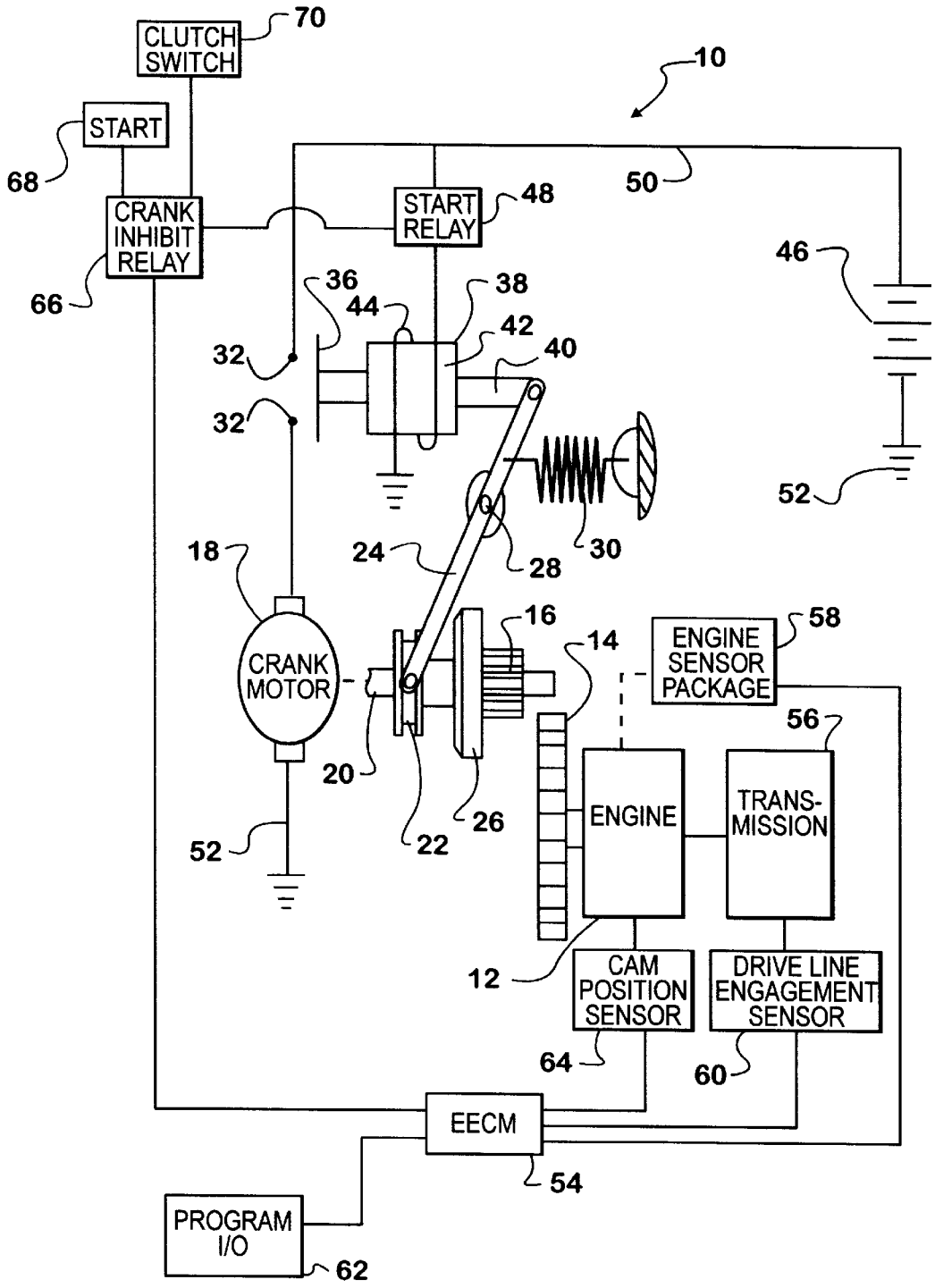
FIG. 1 is a block diagram of a starting system for an internal combustion engine.

Referring now to the figures and in particular to FIG. 1, an engine cranking system 10 is generally depicted. Engine cranking system 10 provides for turning the crankshaft (not shown) an internal combustion engine 12 as part of starting the engine. The major features of engine cranking system 10 are well known in the art and include an engine ring gear 14 external to engine 12 which is mounted on an engine crank shaft, which, in an engine of conventional design, is connected to each of a plurality of pistons which reciprocate in cylinders. A pinion 16, which extends on the armature shaft 20 of cranking motor 18 turns the ring gear 14 when engaged with the ring gear.

Pinion 16 is intended to engage ring gear 14 only when cranking of engine 12 is required for starting the engine. When the engine 12 is running, that is compression of air and fuel for ignition is sustainable by power being generated by igniting fuel, pinion 16 is withdrawn from engagement with ring gear 14. Any number of mechanisms may be employed to controlling the positioning of pinion 16 and the illustrated system is to be taken as a general representation. A common feature to most such control systems is a solenoid. Pinion 16 is mounted on an armature shaft 20 which includes an overrunning clutch 26 and a shift collar 22. A shift lever 24, mounted on a pivot 28, is connected to the shift collar to move the armature shaft back and forth to bring the pinion 16 into and out of engagement with ring gear 14. A spring 30 is connected to shift lever 24 in a way to bias the lever to bring pinion 16 out of engagement with ring gear 14. Extending from solenoid 38 is a solenoid link 40 which is connected to shift lever 24 at the opposite end of the lever from shaft collar 22. Solenoid link 40 moves with solenoid plunger 42 to move shift lever 24 in response to energization of solenoid 38 from a battery 46 through a start relay 48.

The solenoid 38 and cranking motor 18 energization circuitry is also conventional. Solenoid 38 has an energization coil 44 which is connectable to a battery power source 46 through a start relay 48. Battery 46 is connected by its positive terminal to the start relay 48 by a power bus 50 and at its negative terminal to chassis ground 52. Battery 46 also energizes cranking motor 18 in response to solenoid 38 operating to close a switch contact 36 between two terminals 32 and 34.

Electronic control of start relay 48 is based in an electronic engine control module (EECM) 54. EECM 54 has a number of functions, however, only those of interest to the implementation of the present invention are described here. EECM 54 is connected to various engine 12 monitoring systems, including an engine sensor package 58 which monitors, among other items, engine oil temperature. EECM 54 is also connected to a drive line engagement sensor 60 which generates a signal indicating whether the vehicle is in gear and to a cam position sensor 64 which tracks the angular position of the engine cam shaft (not shown). The derivative against time of the cam position signal from cam position sensor 64 indicates engine rotational speed and accordingly, the cam position sensor 64 can be used as an engine tachometer. EECM 54 is a programmable microcomputer and can be reprogrammed as indicated by a programming interface (Program. I/O) 62.

Normally, the engine is started by depressing a start switch 68 which closes the start relay 48 to energize both cranking motor 18 and solenoid 38. Both start switch 68 and EECM 54 are connected to a crank inhibit relay 66 which controls activation of the start relay 48. On vehicles with manual transmission, a clutch switch 70 is also connected to the crank inhibit relay 66. Before cranking is allowed all three signal sources must assume the proper state. Essentially, the clutch pedal and start button must be depressed and the EECM 54 must signal that engine conditions permit cranking.

Figure 2:
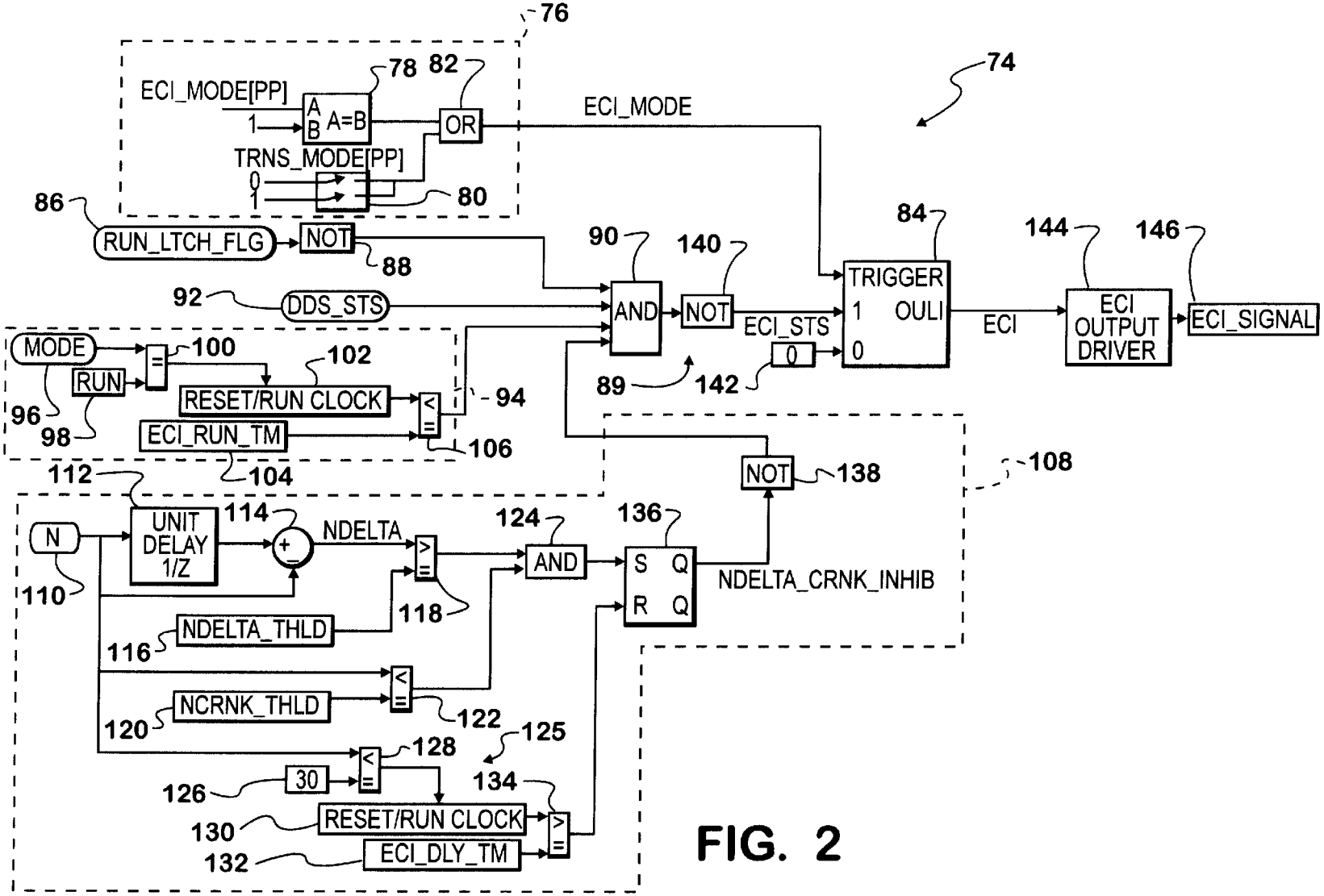
FIG. 2 is a logic diagram for an engine control module used to implement the present invention.

FIG. 2 illustrates a logical implementation of a cranking inhibit control system 74. Cranking inhibit control system 74 is preferably implemented in software executed in EECM 54. Where implemented in logic, cranking inhibit control system 74 may be readily activated or deactivated as a vehicle option by option trigger module 76. Option trigger module provides that the cranking inhibit control system 74 is always activated if the vehicle on which the system is installed is equipped with an automatic transmission. On vehicles with standard transmissions, activation of the control system is optional. Option trigger module 76 includes a programmable mode comparator 78 to implement the option selection feature. If a programmable parameter "ECI_MODE" is set a logical 1, it signifies that the cranking inhibit logic control system 74 is to be activated regardless of the transmission type installed on the vehicle. Programmable mode comparator will pass a logical 1 to OR gate 82 which in turn passes a logical high signal to the trigger input of a triggered comparator 84 activating the device.

For certain transmission types, including automatic transmissions, the crank inhibit control system 74 is always active. A transmission mode (TRNS_MODE) switch set 80 is set to 1 for automatic transmissions and to 0 for standard transmission vehicles. Thus the output of OR gate 82 is high if either (or both) comparator 78 or switch set 80 provides a high logical output (ECI_MODE=1). Where the output of OR gate 82 is low then ECI_MODE=0. ECI_MODE=0 locks the output (ECI) of the bistable state circuit 84 low, while ECI_MODE=1 allows the triggered comparator 84 to assume either a high or low output state.

It is desirable to inhibit cranking of an engine when any of several circumstances arise. Accordingly, cranking inhibit control system 74 provides logic or inputs for the detection and evaluation of these circumstances. The logic or inputs include a run latch flag (RUN_LTCH_FLG) 86 input, disengaged driveline status (DDS_STS) 92 input, a programmable run mode timer 94 and the rock back cranking prevention logic 108 of the present invention. The outputs from each of these elements provides the input to a NAND logic array 89 comprising AND gate 90 and NOT gate 140, which in turn generates an engine crank inhibit status flag (ECI_STS). ECI_STS must equal 0 before cranking is permitted. The occurrence of any one of the cranking inhibit conditions will prevent engine cranking since all of the inputs to NAND array 89 must be high before ECI_STS=0. ECI_STS and the output of register 142 provide the inputs to triggered comparator 84, which generates a high engine crank inhibit signal when the input signals all match. Since the output of register 142 is locked at 0, this requires ECI_STS=0. ECI is amplified by application to an engine cranking inhibit output driver 144 which provides an engine cranking inhibit signal (ECI_SIGNAL) to the crank inhibit relay 66.

The specific logical inputs relating to engine conditions which prevent engine cranking are now considered. The first three elements discussed, the run latch flag 86, the disengaged driveline signal status 92 and the programmable run mode timer 94 are known from the prior art and are not discussed at length. The run latch flag (RUN_LTCH_FLG) 86 goes high whenever the engine has been running above a minimum threshold speed for greater than some fixed time period, e.g. 5 seconds. The run latch flag 86 is inverted by a NOT gate 88 before application to an input to NAND array 89. Thus the input to the NAND array 89 is high only if the engine has not been running above the threshold speed, or has been running above the threshold for fewer than 5 seconds.

The driveline must be disengaged to prevent cranking, which is reflected by a disengaged driveline signal status (DDS_STS) 92 of 1. When the driveline is engaged DDS_STS=0.

The programmable run mode timer 94 applies a high input to NAND array 89 when the engine has been running (i.e. rotating at a speed exceeding a minimum threshold rotational velocity) for a period exceeding a minimum, programmable time threshold (supplied from ECI_RUN_TM register 104). Programmable run mode timer 94 receives an engine mode input 96 on an equality comparator gate 100. The value of mode input 96 equals 2 if the engine is in run mode. Comparator 100 receives a static RUN value of 2 on its second input, and produces a logical high output if and only if the values for MODE and RUN are equal.

The output of comparator 100 is applied to a reset/run clock 102 which is set to 0 and starts running when the output of comparator 100 undergoes a low to high transition. The clock signal from clock 102 is applied to inequality comparator 106 for comparison with a static, but programmable value supplied from ECI_RUN_TM register 104. When the clock is less than the programmable value the output from the comparator is high. Thus for cranking to be allowed after engine start the engine must be in run mode and have been in run mode for less that the programmable time limit. Where an engine is not in run mode the output of comparator 100 is zero and the clock 102 output is zero, allowing engine cranking.

Rock back cranking prevention logic 108 constitutes a preferred embodiment of the invention, incorporated as extended logic to cranking inhibit control system 74. Rock back prevention logic 108 monitors engine rotational speed (N) 110 derived from cam position sensor 64 or another class of engine tachometer. Essentially, prevention logic 108 generates a delay period subsequent to the cessation of cranking following a failure to start engine 12 during which a resumption of cranking is inhibited. When realized in software, prevention logic 108 achieves this objective without the addition of physical components such as reset switches attached to the start button 68 and requires only monitoring of an existing engine tachometer signal.

Engine speed signal 110 is routed to each of three analytical elements, a first which derives changes in engine rotational speed, a second which compares engine speed to a minimum threshold and a third which provides for reset of the prevention logic 108. Changes in engine speed (NDELTA) is produced by applying the engine speed signal N 110 to a delay element 112. The delayed signal is then applied to one input of a difference summer 114. The current engine speed signal N is applied to the remaining terminal of difference summer 114 and subtracted from delayed signal. The absolute value of this difference signal NDELTA is then applied to engine speed change comparator 118 for comparison to a threshold level NDELTA_THLD 116. Should NDELTA equal or exceed NDELTA_THLD, a high logic level signal is provided as an input to AND gate 124.

It is undesirable that AND gate 124 should pass a set signal to logical flip flop 136 prematurely, i.e. while engine speed is high. That situation is handled by the RUN_LTCH_FLG and run mode timer 94 logic. Changes in engine speed signals, NDELTA, meeting the threshold NDELTA_THLD are allowed to trigger a cranking inhibit signal only if absolute engine speed N has fallen below (or equal to) a minimum threshold NCRANK_THLD 120. A comparator 122, taking N 110 and NCRANK_THLD 120 is provided to determine the occurrence of this event and applies a high logic level signal to a second, and only remaining, input of AND gate 124. When the outputs of both comparator 118 and 122 have simultaneously gone high a set signal is generated and applied to the S input of logical flip flop 136 and the Q output (NDELTA_CRNK_INHIB) goes high. This signal is inverted, i.e., set to logical 0, at NOT gate 138 to provide a low input to NAND array 89, thereby inhibiting engine cranking. The value for NCRANK_THLD 120 may be made dynamic to reflect changing engine starting dynamics which occur at different engine temperatures. In this case NCRANK_THLD 120 may be set as a function of engine oil temperature which is obtained from the engine sensor package 58.

The time delay aspect of the rock back cranking prevention logic 108 is handled by reset logic 125 for the logical flip flop 136. Again engine speed N provides the prime input to a comparator 128. Here engine speed N is compared to a minimum rotational speed 30 of RPM provided from register 126 to determine if the engine has substantially stopped, which is indicated by N falling to or below the reference level supplied by register 126. Occurrence of this event results in a reset/run signal being applied to reset/run clock 130. Once the time elapsed as tracked by clock 130 equals or exceeds a minimum threshold time delay ECI_DLY_TM 132 as determined by comparator 134. Comparator 134 applies a reset signal in response to the clock 130 output passing ECI_DLY_TM to the reset input of flip flop 136. The Q output NDELTA_CRNK_INHIB goes high, which in turn pulls the output of NOT gate 138 low, with the result that rock back cranking prevention logic 108 no longer inhibits cranking.

The invention of the present invention utilizes engine crank inhibit circuitry currently in common use on vehicles. Software modifications of an electronic engine control system are sufficient to implement the control regimen, although the system may be implemented in hardwire circuitry. Because the EECM has no hardwire connection to either the ignition switch or to a start button and develops the inhibit signal without reference to the position of the ignition switch, saving expense over prior art systems.

While the invention is shown in only one of its forms, it is not thus limited but is susceptible to various changes and modifications without departing from the spirit and scope of the invention.

What is claimed is:

1. A control system for an electric starter to an internal combustion engine, the control system comprising:

a starter switch;

an engine crank shaft ring gear;

a cranking motor;

a pinion rotatably driven by the cranking motor;

a pinion positioner for selectively engaging and disengaging the pinion and engine crank shaft ring gear;

a tachometer for generating an engine rotational speed signal; and control logic responsive to the engine rotational speed signal for determining deceleration of the engine indicative of resetting the start switch to off and further responsive to deceleration of the engine for generating an engine crank inhibit signal of one of two states.

2. A control system as claimed in claim 1, wherein the control logic further comprises:

a delay line connected to the tachometer to receive the engine rotational speed signal and responsive thereto for producing a delayed engine rotational signal;

a summing element connected to receive the engine rotational speed signal and the delayed engine rotational speed signal to produce a difference signal;

a source of a difference threshold reference signal; and a comparator taking the difference signal and the difference threshold reference signal as inputs and responsive thereto for generating a minimum speed change indication signal of one of two states, where a first state indicates a change in engine rotational velocity consistent with cessation of engine cranking and a second state indicating otherwise.

3. A control system as claimed in claim 2, wherein the control logic further comprises:

a source of an engine speed reference signal;

a comparator taking the engine speed reference signal and the engine speed signal as inputs to produce a minimum engine speed signal of one of two states, where a first state indicates that engine speed falls below a minimum threshold and a second state which indicates that engine speed exceeds a minimum threshold;

a logical AND gate taking the minimum speed signal and the minimum speed change indication signal as inputs to provide a cranking inhibit set signal.

4. A control system as claimed in claim 3, wherein the control logic further comprises time delay reset element.

5. A control system as claimed in claim 4, wherein the time delay reset element further comprises:

a source of an engine off reference signal;

a resettable clock;

a comparator taking the engine off reference signal and the engine rotational speed signal as inputs to apply a clock reset signal to the resettable clock in response to the engine rotational speed failing below the engine off reference signal;

a source of a time threshold level; and a clock comparator taking the output of the resettable clock and the time threshold level as inputs and generating a reset signal in response to the output of the resettable clock exceeding the time threshold level.

6. A control system as claimed in claim 5, further comprising a flip flop element connected to the AND gate to take the cranking inhibit set signal as a set input and to the output of the clock comparator as a reset input and generating a cranking inhibit signal of one of two states, a first state indicating that cranking is inhibited and a second state indicating otherwise.

7. A control system as claimed in claim 6, further comprising:

a crank inhibit relay connected to the starter switch and to the control logic to receive the engine crank inhibit signal and generating an activation signal in one of two states; and a solenoid start relay connected to the crank inhibit relay to receive the activation signal.

8. A control system as claimed in claim 7, wherein a first state of the engine crank inhibit signal prevents cranking of the internal combustion engine.

9. A control system as claimed in claim 7, wherein a second state of the engine crank inhibit signal allows cranking of the internal combustion engine.

10. An engine controller for generating a command signal for application to an engine cranking system, comprising:

a source of an engine rotational velocity signal;

a delay line connected to the source of the engine rotational velocity signal for generating a delayed engine rotational velocity signal;

a subtracting circuit connected to the source of the engine rotational velocity signal and the delay line to produce a rotational velocity change signal;

a source of an engine rotational velocity change threshold level;

a comparator taking the engine rotational velocity change threshold level and the rotational velocity change signal as inputs and generating a first indication signal;

a source of an engine rotational velocity threshold level;

a comparator taking the engine rotational velocity threshold level and the engine rotational velocity signal as inputs and producing a second indication signal; and an AND gate taking the first and second indication signals as inputs for setting an engine rate change status signal to inhibit engine cranking when both the first and second indication signals assume a first of two states.

11. An engine controller as set forth in claim 10, further comprising:

a source of engine off rotational velocity level;

an engine velocity comparator connected to receive the engine rotational velocity signal and the engine off rotational velocity level and producing an engine off signal at a set level if the engine rotational velocity signal indicates a minimum engine speed;

a reset clock initialized in response to the output signal of the engine velocity comparator assuming the set level;

a source of time delay value;

a reset comparator connected to receive the reset clock output and the time delay value for generating a reset signal for resetting the engine rate change crank signal.

12. An engine controller as claimed in claim 11 further comprising:

a source of a drive line status signal;

a source of an engine mode signal;

a source of a run latch flag;

a programmed engine mode level;

a programmed time threshold;

a comparator taking the programmed engine mode level and the engine mode signal as inputs to generate a clock initiation signal in response the engine mode signal matching the programmed engine mode level;

a source of time threshold;

a clock connected to receive the clock initiation signal;

a comparator taking the output of the clock and the source of the time threshold for generating a command signal of one of two values; and and AND gate taking the run latch flag, the drive line status, the command signal and the delta crank inhibit signal all as inputs to generate and engine crank enable status signal.

13. An engine controller as claimed in claim 11, further comprising a programmable enable element.

* * * * *